US006799921B2

(12) United States Patent
Kodama

(10) Patent No.: US 6,799,921 B2
(45) Date of Patent: Oct. 5, 2004

(54) MANHOLE COVER/FRAME EXCHANGE METHOD

(75) Inventor: Toshiharu Kodama, Kanagawa-ken (JP)

(73) Assignee: Shiga Sangyo Kabushiki Kaisha, Fujisawa (JP)

( * ) Notice: Subject to any disclaimer, the term of this patent is extended or adjusted under 35 U.S.C. 154(b) by 93 days.

(21) Appl. No.: 10/419,547

(22) Filed: Apr. 21, 2003

(65) Prior Publication Data

US 2003/0235469 A1 Dec. 25, 2003

(30) Foreign Application Priority Data

Apr. 26, 2002 (JP) ..... 2002-126383
Apr. 1, 2003 (JP) ..... 2003-097976

(51) Int. Cl.[7] ..... E02D 29/14
(52) U.S. Cl. ..... 404/72; 52/20; 404/25
(58) Field of Search ..... 52/19, 20; 404/25, 404/26, 72, 73, 75

(56) References Cited

FOREIGN PATENT DOCUMENTS

| | | | | |
|---|---|---|---|---|
| EP | 0231454 | | 8/1987 | ..... E02D/29/14 |
| EP | 1182299 | | 2/2002 | ..... E02D/29/14 |
| EP | 1357228 | | 10/2003 | ..... E01C/23/09 |
| EP | 030093876 | | 10/2003 | |
| JP | 59072325 A | * | 4/1984 | ..... E02D/29/12 |
| JP | 2-15687 | | 4/1990 | |
| JP | 03002425 A | * | 1/1991 | ..... E02D/29/14 |
| JP | 09158114 | | 6/1997 | ..... E01C/23/09 |
| JP | 2000135711 | | 5/2000 | ..... B28D/1/04 |
| JP | 2000-135711 | | 5/2000 | ..... B28D/1/04 |
| JP | 2000336682 A | * | 12/2000 | ..... E01C/23/09 |
| JP | 2001-294469 | | 10/2001 | ..... C04B/28/02 |
| JP | 20001294469 | | 10/2001 | ..... C04B/28/02 |
| JP | 2001-317009 | | 11/2001 | |
| JP | 2001-348810 | | 12/2001 | |
| JP | 2002-167708 | | 6/2002 | |
| JP | 2002167787 A | * | 6/2002 | ..... E02D/29/14 |
| WO | WO 200244477 A | * | 6/2002 | ..... E02D/29/14 |

OTHER PUBLICATIONS

European Search Report, Jul. 25, 2003.

* cited by examiner

*Primary Examiner*—Robert E. Pezzuto
*Assistant Examiner*—Alexandra K. Pechhold
(74) *Attorney, Agent, or Firm*—Carella, Byrne, Bain, Gilfillan, Cecchi et al.; Elliot M. Olstein; William Squire

(57) ABSTRACT

The present invention provides a manhole cover/frame exchange method capable of minimizing the size of a portion to be mended, of eliminating a pressing step by a roller machine, of eliminating/reducing steps and a required mending time and of suppressing vibrations, noises and the like during the exchanging process. The manhole cover/frame exchange method comprises steps of: cutting a portion of a paved road around the manhole cover/frame spherically; removing the spherically cut portion; filling a self-curing highly fluid non-shrink filler into a spherical hollow space formed by the removing step, and filling a surface layer material over the self-curing highly fluid non-shrink filler. Thus, the pressing step by the roller machine is eliminated by the present invention.

5 Claims, 5 Drawing Sheets

MANHOLE COVER/FRAME EXCHANGE METHOD

BACKGROUND OF THE INVENTION

1. Field of the Invention

The present invention relates to a manhole cover/frame exchange method in electric power supply systems, telecommunication systems, water supply and drainage systems and the like.

2. Brief Description of the Related Art

In conventional construction works for exchanging manhole covers/frames of electric power supply systems, telecommunication systems, water supply and drainage systems and the like, paved roads around manholes are cut in a square or in a circle shape perpendicular to the ground by utilizing cutters or core-cutters with straight blades. Cut portions around the manholes are removed, removed portions are filled with mending materials and pressed by roller machines.

A Japanese published patent No. 2-15687 discloses a paved road cutting/removing method including a cutting step to cut a portion of a paved road to be removed into a plate and a removing step to lift the cut portion in which one or two anchor bolts are buried. The cut portion shows a circular or rectangular plate shape. When the cut portion is the rectangular plate, at least two facing sides of the plate are tapered toward the ground.

However, in the above-mentioned conventional method, when the paved roads are cut in the square shape, edged corners are formed (see FIG. 4B). Unfilled vacancies are apt to be formed in these edged corners during a mending step, since fillers as mending materials are filled into not all over the edged corners. Since the paved road is cut perpendicular to the surface of paved road in the circular cutting as well as in rectangular cutting, mended portions are supported only by a frictional force F of mending materials against perpendicular walls of cut portions of the paved road. Consequently, mended portions are apt to sunk and gaps are formed. Mended portions are further sunk due to penetrated rainwater into these gaps, which might cause an accident.

In the case of the square cutting, more mending materials are required in order to fill the edged corners shown in FIG. 4B.

As mentioned above, inconveniences such as sunk and/or irregular surfaced portions are caused in the paved road with the passage of time, unless a step to fill mending materials into edged corners and a rolling step to press filled portions with mending materials, are performed.

Besides, in conventional mending methods there are problems such as difficulties to shorten a mending term including a cure time of conventional filling materials to a large extent and to suppress noises generated during the mending process.

SUMMARY OF THE INVENTION

The present invention is carried out in view of solving the above-mentioned problems to provide a manhole cover/frame exchange method capable of minimizing the size of a portion to be mended, of eliminating a pressing step by a roller machine, of eliminating/reducing steps and mending terms and of suppressing vibrations, noises and the like during the mending process.

The above-mentioned problems are solved by the following constitutions by the present invention.

(1) A manhole cover/frame exchange method for exchanging manhole cover/frame of an electric power system, a telecommunication system, a gas supply system and a water supply and drainage system comprising steps of: cutting a portion of a paved road around the manhole cover/frame spherically; removing the spherically cut portion; filling a self-curing highly fluid non-shrink filler into a spherical hollow space formed by the removing step, and filling a surface layer material over the self-curing highly fluid non-shrink filler, wherein: a pressing step by a roller machine is eliminated.

(2) The manhole cover/frame exchange method according to (1), wherein: the highly fluid non-shrink filler mainly consists of mortars containing metallic non-shrink materials such as calcium-sulfo-aluminates.

(3) The manhole cover/frame exchange method according to (1), wherein: the highly fluid non-shrink filler mainly consists of mortars containing non-metallic non-shrink materials, but not containing metallic aggregates.

(4) The manhole cover/frame exchange method according to (1), wherein: a material containing fibrous materials is employed as the surface layer material.

(5) The manhole cover/frame exchange method according to (1), wherein: a reinforcing iron rod network is arranged when the highly fluid non-shrink filler is filled.

DETAILED DESCRIPTION OF THE PREFERRED EMBODIMENTS

The present embodiment employs a cutting apparatus for paved road disclosed by a Japanese laid open patent No. 2001-295216 (corresponding to U.S. Pat. No. 6,425,638 B1) or a Japanese filed patent No. 2002-60514 by the applicant so that a portion around the manhole cover/frame is cut spherically in a necessary minimum range.

Hereinafter mending steps are explained as referring to FIGS. 1 to 5B.

Figure 1:
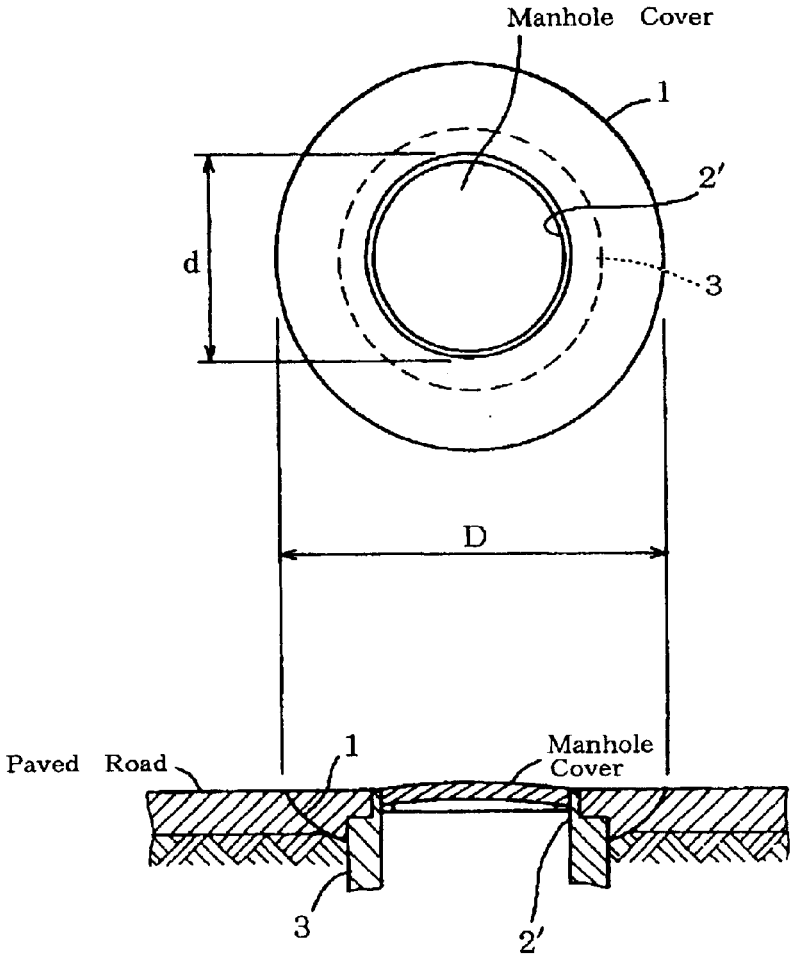
FIG. 1 is a view for explaining a status where a portion around a manhole cover/frame is cut spherically by a cutting apparatus for cutting a paved road equipped with a spherical shell disk cutter.

As shown FIG. 1, a cutting radius D of the above-mentioned cutting apparatus equipped with the spherical shell disk cutter is set 1000 mm, when a diameter d the original frame 2' of a manhole is 654 mm. The cutting apparatus is revolved in 360° after wheel angles of the cutting apparatus is determined by a one-touch operation, so that a spherically cut circle 1 is formed around the manhole.

Figure 2A:
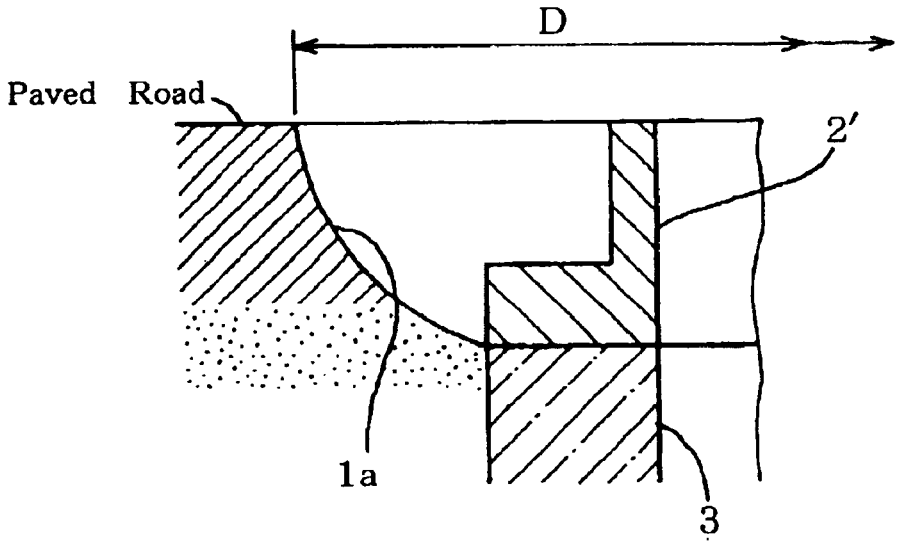
FIG. 2A is a sectional view showing a removed status of the spherically cut portion around the manhole cover/frame.
Figure 2B:
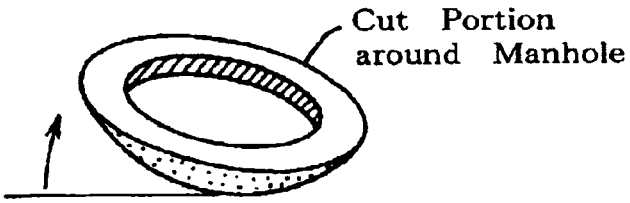
FIG. 2B is a schematic perspective view showing the removed spherically cut portion.

An annularly (doughnut-shaped) cut portion as shown in FIG. 2B is removed so as to form an annularly shaped (doughnut-shaped) hollow space around the manhole as shown in FIG. 2A. After the manhole cover and the original manhole frame 2' are removed, an upper surface of a lower duct 3 is cleaned.

Figure 3A:
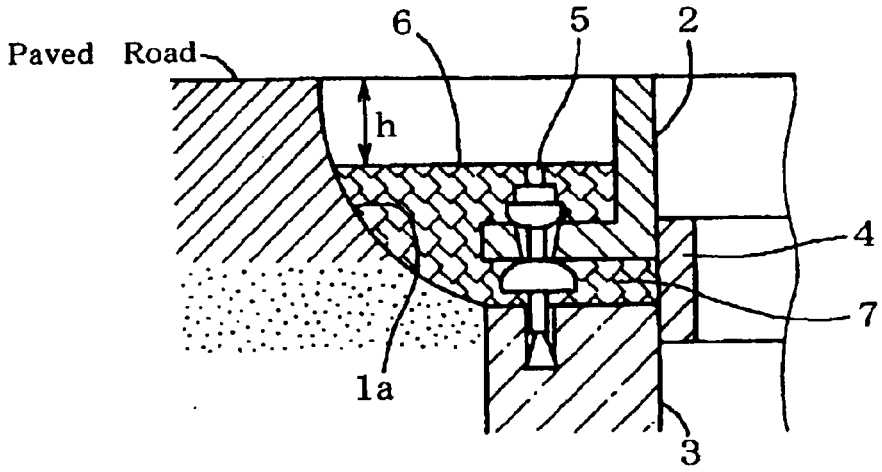
FIG. 3A is a detailed sectional view showing a status where a roadbed material and a frame position adjusting material are filled around the manhole cover/frame.
Figure 3B:
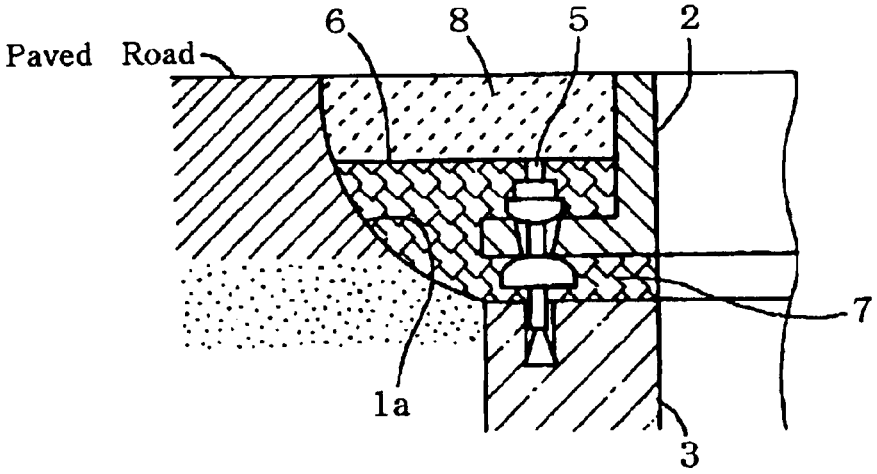
FIG. 3B is a detailed sectional view showing a status where a surface layer material is filled around the manhole cover/frame.

After anchor bolts 5 having height-adjusting members are set and adjusted their heights as shown in FIGS. 3A and 3B, a new manhole frame 2 and an inner mold frame 4 are fitted. After a roadbed material 6 and a frame position adjusting material 7 are filled and cured for a predetermined period (ca. 19 minutes), a surface layer material 8 containing fibrous materials is filled in by a thickness h, for example 50 mm. A finishing treatment is performed on the filled surface layer material 8 such that the finished surface does not protrude above the paved road level. The mending process is finished when the filled surface layer material 8 is cured for ca. 30 minutes.

A total mending time is 2 hours and 14 minutes in the present embodiment.

Self-curing highly fluid non-shrink fillers consisting of mortars containing metallic non-shrink materials such as calcium-sulfo-aluminates and the like are employed as the roadbed material 6 and frame position adjusting material 7.

In addition, since the fillers as the mending materials are cured up to a predetermined hardness in a short period, a required time for finishing the mending process is less than 3 hours (which varies according to seasons and circumstances to a certain extent) in total. Thus a required time for the mending process is reduced to less than ½ of the required time for the conventional methods.

Figure 4A:
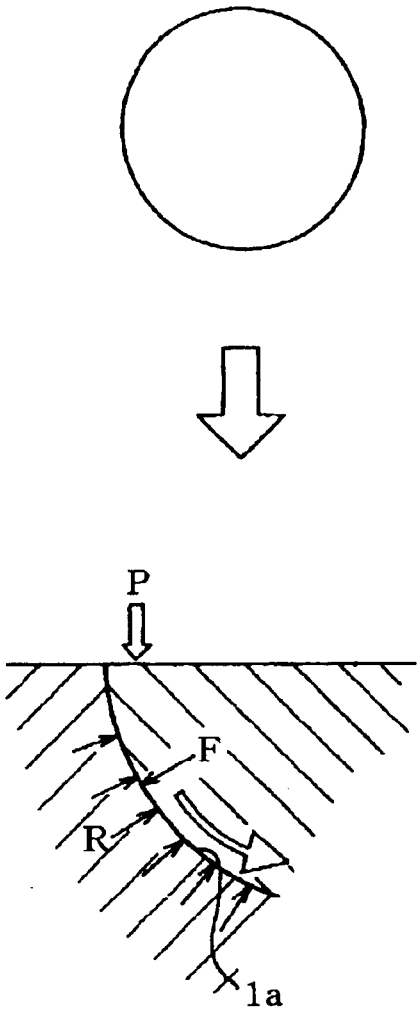
FIG. 4A is an explanatory view illustrating a cutting method around the manhole cover/frame by the present invention.
Figure 4B:
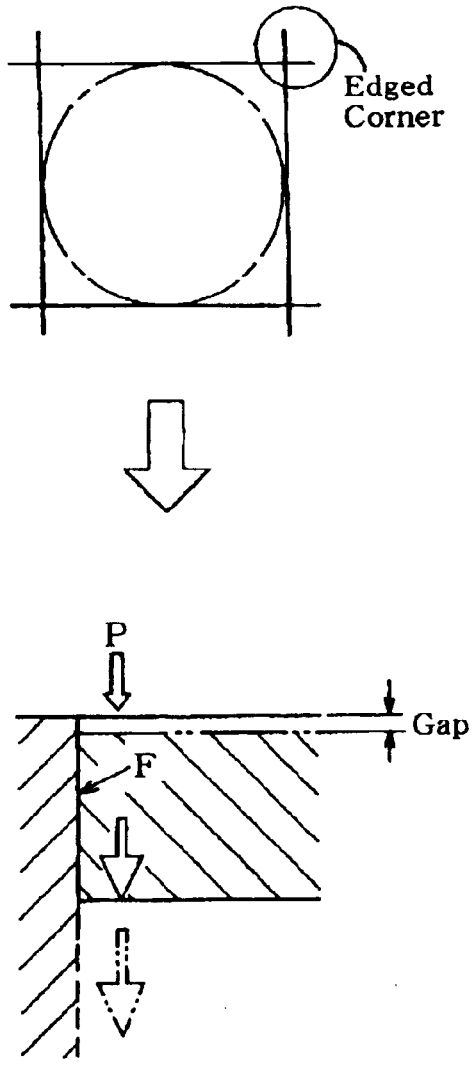
FIG. 4B (PRIOR ART)
FIG. 4B is an explanatory view illustrating a conventional cutting method around the manhole cover/frame.

The cut portion in the present method does not have a columnar section as shown in FIG. 4B formed by the conventional methods, but has the spherical cut section 1*a* as shown in FIG. 4A. Consequently, the filled portion is supported by reaction forces R toward the spherical center of the cut section 1*a* generated from a downward load P as well as a frictional force F against the spherically cut portion 1*a* of the paved road. In other words, the heavier the load P caused by a vehicle on the paved road is, the more enhanced an adhesive property between the filled material and spherically cut portion 1*a* is. As a result, mended portions by the present invention do not have inconveniences often observed in conventional mending methods as sinking phenomena as shown in FIG. 4B caused by penetrated rainwater into gaps formed between cut columnar surfaces of paved road and mended portions. Thus, operational steps by the present invention for exchanging manhole covers/frames can be carried out safely and swiftly without causing any inconveniences.

(Other Embodiment 1)

A different feature of the present embodiment is that mortars do not contain metallic aggregates, but contain non-metallic non-shrink materials as the high fluid non-shrink fillers.

(Other Embodiment 2)

Figure 5A:
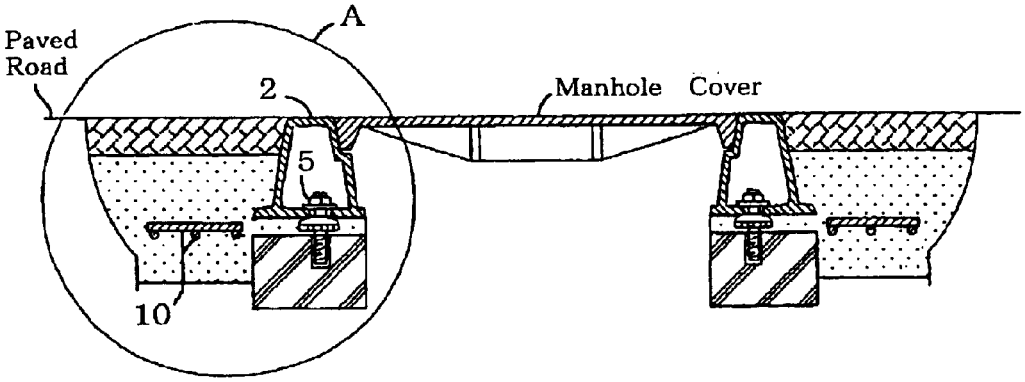
FIG. 5A is a sectional view showing a mended status where reinforcing iron rod network is arranged around the manhole cover/frame by the present invention.
Figure 5B:
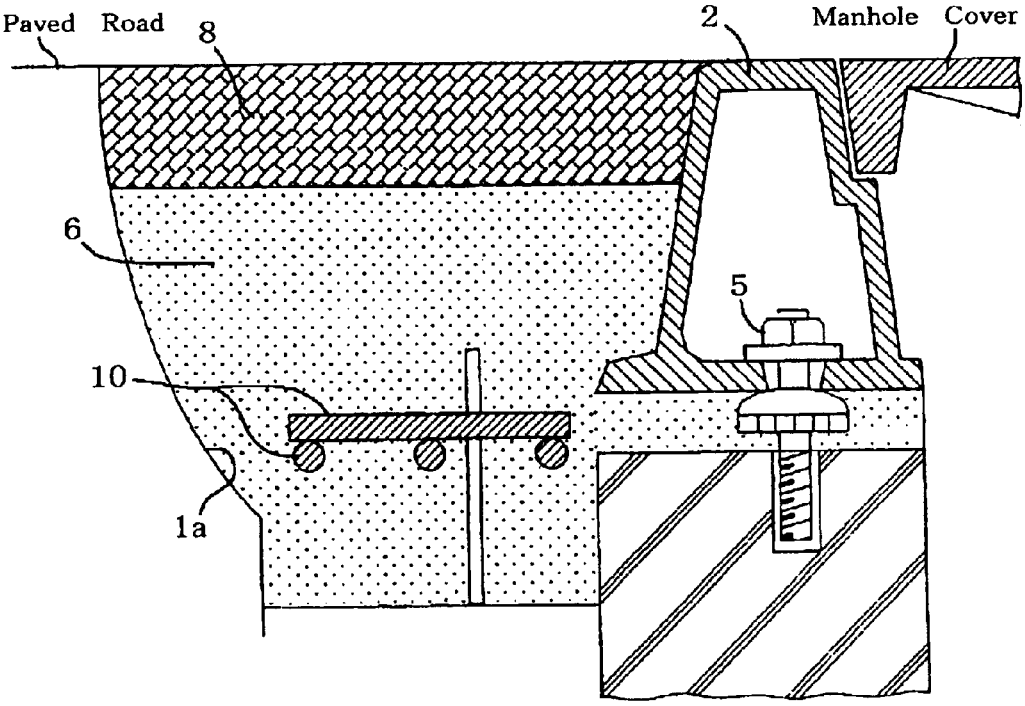
FIG. 5B is an enlarged view of an encircled portion A in FIG. 5A.

In the present embodiment, mended portions are safely maintained by arranging reinforcing iron rods 10 with a predetermined diameter formed in a network with a predetermined pitch in the roadbed material as shown in FIGS. 5A and 5B, even when peripheral portions of the roadbed are collapsed. Since other reference characters (or numerals) in FIGS. 5A and 5B are the same as the previous embodiment, further explanation is omitted.

The embodiments by the present invention are explained in cases when highly fluid non-shrink fillers are employed. Fillers are not limited to those explained above, but any materials can be employed as far as materials which can omit pressing or tamping steps by roller machines or which require only a slight manual pressing step.

As explained above, the present invention can provide the manhole cover/frame exchange method capable of minimizing the size of the portion to be mended, capable of eliminating the pressing step by the roller machine, capable of eliminating/reducing steps and terms required for mending and capable of suppressing vibrations, noises and the like during the mending process.

What is claimed is:

1. A manhole cover/frame exchange method for exchanging manhole cover/frame of an electric power system, a telecommunication system, a gas supply system and a water supply and drainage system comprising steps of:

cutting a portion of a paved road around said manhole cover/frame spherically;

removing said spherically cut portion;

filling a self-curing highly fluid non-shrink filler into a spherical hollow space formed by said removing step, and filling a surface layer material over said self-curing highly fluid non-shrink filler, wherein:

a pressing step by a roller machine is eliminated.

2. The manhole cover/frame exchange method according to claim 1, wherein:

said highly fluid non-shrink filler mainly consists of mortars containing metallic non-shrink materials such as calcium-sulfo-aluminates.

3. The manhole cover/frame exchange method according to claim 1, wherein:

said highly fluid non-shrink filler mainly consists of mortars containing non-metallic non-shrink materials, but not containing metallic aggregates.

4. The manhole cover/frame exchange method according to claim 1, wherein:

a material containing fibrous materials is employed as said surface layer material.

5. The manhole cover/frame exchange method according to claim 1, wherein:

a reinforced iron rod network is arranged when said highly fluid non-shrink filler is filled.

* * * * *